US007416066B2

(12) United States Patent
Chernoff

(10) Patent No.: US 7,416,066 B2
(45) Date of Patent: Aug. 26, 2008

(54) WHEELED SUITCASE WITH DETACHABLE GARMENT BAG

(76) Inventor: Donald L. Chernoff, 2226 Chestertown Dr., Vienna, VA (US) 22182

( * ) Notice: Subject to any disclaimer, the term of this patent is extended or adjusted under 35 U.S.C. 154(b) by 333 days.

(21) Appl. No.: 11/214,782

(22) Filed: Aug. 31, 2005

(65) Prior Publication Data

US 2005/0284717 A1 Dec. 29, 2005

Related U.S. Application Data

(63) Continuation-in-part of application No. 10/661,957, filed on Sep. 15, 2003, now abandoned.

(60) Provisional application No. 60/451,238, filed on Mar. 3, 2003.

(51) Int. Cl.
*A45C 3/00* (2006.01)

(52) U.S. Cl. ..... 190/108; 190/18 A; 190/115; 206/287.1; 206/287

(58) Field of Classification Search ..... 190/108, 190/20, 18 A, 370, 107, 115; 206/287, 287.1
See application file for complete search history.

(56) References Cited

U.S. PATENT DOCUMENTS

| | | | | | |
|---|---|---|---|---|---|
| 2,472,491 | A | | 6/1949 | Quinton | |
| 2,805,077 | A | * | 9/1957 | Katz | 280/47.131 |
| 3,156,213 | A | * | 11/1964 | Patten | 119/497 |
| 4,170,282 | A | * | 10/1979 | Schwartzstein | 206/287.1 |
| 4,206,835 | A | * | 6/1980 | Shapiro | 190/108 |
| 4,598,803 | A | | 7/1986 | Ghiassi | |
| 4,655,343 | A | * | 4/1987 | Lane et al. | 206/287.1 |
| 4,915,402 | A | | 4/1990 | Brinker | |
| 4,995,487 | A | | 2/1991 | Plath | |
| 5,005,679 | A | | 4/1991 | Hjelle | |
| 5,240,106 | A | | 8/1993 | Plath | |
| 5,311,972 | A | | 5/1994 | Plath | |
| 5,323,887 | A | | 6/1994 | Scicluna et al. | |
| 5,547,052 | A | * | 8/1996 | Latshaw | 190/108 |
| 5,624,026 | A | | 4/1997 | Chernoff | |
| 5,645,146 | A | | 7/1997 | Bieber et al. | |
| 5,671,832 | A | | 9/1997 | London et al. | |
| 5,743,363 | A | | 4/1998 | Rekuc et al. | |
| 6,035,982 | A | | 3/2000 | Wei-Chih | |
| 6,098,769 | A | | 8/2000 | Yen | |
| 6,109,402 | A | | 8/2000 | Godshaw et al. | |
| 6,220,412 | B1 | | 4/2001 | Lin | |
| 6,805,225 | B2 | * | 10/2004 | Freedman | 190/112 |
| 2005/0016810 | A1 | * | 1/2005 | Feng | 190/115 |

* cited by examiner

*Primary Examiner*—Tri M Mai
(74) *Attorney, Agent, or Firm*—Donald Grant Kelly

(57) ABSTRACT

An apparatus for transporting clothing comprising a wheeled suitcase and a detachable garment bag. The garment bag is adapted to wrap around outside panels of the suitcase and is held snuggly against the suitcase by a fastener system including connectively interlocking clips or the like. Auxiliary hook and loop strips ensure that the garment bag is securely held on the suitcase. The wheeled suitcase, in its generally upright position, includes an upper end and lower end. The upper end has an opening free of the wrapped garment bag affording ready access. Corners of the suitcase are rounded to facilitate gentle wrapping such that clothing within the garment bag is not subject to folding or wrinkling. The suitcase is slightly smaller than the size limited by airline regulations for carry-on luggage. Thus, when wrapped with the unique garment bag, the combined suitcase and garment bag will not exceed regulations.

8 Claims, 4 Drawing Sheets

WHEELED SUITCASE WITH DETACHABLE GARMENT BAG

CROSS REFERENCE TO RELATED APPLICATIONS

This application is a Continuation-in-Part of non-provisional patent application Ser. No. 10/661,957, filed on Sep. 15, 2003 and now abandoned; in turn, entitled to the benefit of provisional patent application Ser. No. 60/451,238 filed Mar. 3, 2003; all benefits of the priority of both such applications are hereby claimed under 35 USC 120 and 119(e) respectively.

STATEMENT REGARDING FEDERALLY SPONSORED RESEARCH OR DEVELOPMENT

Not applicable

REFERENCE TO SEQUENCE LISTING

Not applicable

REFERENCE TO "MICROFICHE APPENDIX"

Not applicable

BACKGROUND OF THE INVENTION

This invention relates to luggage both of the wheeled variety and the foldable type adapted to transport relatively large clothing pieces such as suits and dresses with minimal wrinkling.

Luggage for transporting clothing typically takes the form of suitcases of the box or trunk style or the foldable variety known as garment carriers or garment bags. Accommodating the carrying of relatively large garment pieces such as suits, jackets, shirts, blouses, and dresses, while avoiding wrinkles, has been an ongoing problem for travelers everywhere. Traditional luggage, commonly referred to as suitcases cannot accommodate large garments such as suits or dresses without folding them to fit inside. Compression and relative friction brought on by folding and packing result in garment wrinkles and unsightly creases.

As a solution to stuffed suitcases, garment bags were introduced as a means of transporting large garments. Garment bags are widely used despite a number of problems encountered with their use. Usually the user must suffer the strain and awkwardness of reaching backward across a shoulder to grasp a hanger hook from which the unfolded garment bag is suspended. Alternatively, the garment bag may be folded for easier handling, but the clothing held therein will suffer. This is because garment bags along with their contents require doubling or folding to a size that, at most, is half their overall length. The objective is to make garment bags just large enough to accommodate suits and dresses, yet small enough to be carried reasonably conveniently, and to permit them to be brought aboard a commercial flight. Occasionally, airline flight personnel will permit hanging the garment bag during flight, but typically the bag must be folded and stuffed into an overhead compartment, where they often are subjected to crushing pressure from adjacent bags of other passengers. The garment bag suffers similar distress in the trunks of taxicabs or the luggage hold of buses.

Another problem with respect to garment bags is they typically add to the luggage load for a user who already is struggling with lifting and managing a regular suitcase or duffle bag. The added load can be inconvenient, tiring and uncomfortable. Besides that, more than one "carry-on" item often is not permitted onboard an airplane. An undesirable outcome is that the "soft" or delicate garment bag may be relegated to bruising transport within the airplane's luggage hold.

A relatively recent development has been luggage with wheels and retractable handles, of the type exemplified by Rollaboard®. Early wheeled luggage of this type is described in the U.S. Pat. No. 4,995,487 issued to Plath. Rather than having to carry the suitcase, the Plath invention enables a user to pull the suitcase in such a way that the load is carried on small wheels or rollers. This type of suitcase has become extremely popular due to the obvious improvement in comfort and convenience to the user.

The most popular types of rolling suitcases are those sized to meet the carry-on width/length/girth limits imposed by airline regulations. Generally speaking, present standards, dictate that the carry-on suitcase will not exceed 22"×14"×9," although such a designated, chosen or dictated dimension can vary slightly from airline to airline and country to country. When it comes to packing and transporting clothing of various shapes and sizes, roller-equipped or wheeled suitcases which, by design, are relatively small, suffer from the same deficiency or inadequacy of larger, non-wheeled suitcases. That is, wheeled suitcases cannot accommodate large garments without considerable folding and compression.

Manufacturers have tried to combine the convenience of the smaller, wheeled and non-wheeled suitcase with the larger clothes-carrying capacity of a garment bag. They accomplish this by incorporating a garment bag within the confines of the suitcase itself. This allows suits and large garments to be inserted inside the suitcase. Luggage of this nature is known in the industry as a suiter. Such a suitcase eliminates the need to carry two separate pieces of luggage; but, the typical suiter is by no means small. In fact it wields a sizable footprint and significant heft. Besides that, the internal garment bag feature consumes valuable packing space. Alas, the so-called suiter suffers the problem common to regular suitcases, garment bags and the smaller wheeled versions: larger articles of clothing must be folded, and often into several folded layers.

In U.S. Pat. No. 6,109,402, Godshaw describes soft-sided luggage with separate compartments in a saddle-bag configuration designed to fit on top of a wheeled type suitcase. An opening in the soft-sided luggage allows it to fit over a handle of wheeled suitcase so as to extend downwardly along the suitcase sides. One embodiment of this design is a garment bag to hold suits. This luggage carries a number of disadvantages.

While the construction contemplated in the Godshaw patent allows clothing to be carried on the outside of wheeled luggage so as to be portably moveable therewith, it faces the same deficiency as previously described luggage because it requires large garments such as suits to be folded to fit into a garment bag portion of the Godshaw luggage. The resultant combination is bulky and heavy, and must be disassembled to afford access the interior of the wheeled suitcase.

In U.S. Pat. No. 5,624,026, Chernoff demonstrates the concept of rolling clothing around a cylinder to reduce wrinkles. This concept of rolling or wrapping large garments for storage, rather than the traditional folding process has been a major step in the right direction since it eliminates many of the problems of folding, thus going a long way in avoidance of wrinkles. However, a garment bag of this type still must be carried since it is in no way associated with wheels.

While the above discussed patent references as well as others of record in the above noted parent application relate to the present invention disclosed and claimed herein, none has the distinguishing features of the present inventive apparatus and method to be discussed below. More specifically, it is believed that prior to this invention there existed no wheeled luggage adapted to carry relatively larger articles of clothing such as suits dresses and the like in such a way that avoids abusive folding required to fit said clothing inside (or to drape it across) wheeled luggage. In other words, none of the prior art includes the novel features of the present inventive and method disclosed and claimed herein.

BRIEF SUMMARY OF THE INVENTION

A principal objective of this invention is to present an improved luggage apparatus and method of using said apparatus that combines the convenience of a wheeled suitcase with the carrying capacity of a large garment bag, while avoiding or at least considerably reducing clothing wrinkles and creases associated with traditional embodiments of both. This invention is embodied in a unique apparatus combination and its method of use. More specifically, the apparatus includes a wheeled suitcase of special and unique configuration and a similarly uniquely configured garment bag adapted to be wrapped around and attached to an outside surface of said wheeled suitcase.

It is an objective to provide a wheeled suitcase structurally defined by six principal exterior surfaces, and adapted to cooperatively support a uniquely configured garment bag wrapped therearound. Four of said exterior surfaces are substantially vertical when said wheeled suitcase is in a standing mode supported by wheels of said suitcase. These four surfaces may be identical in configuration, or more typically may include two major, generally vertical panel surfaces and two minor generally vertical panel surfaces.

Such generally vertical surfaces may be interconnected to form relatively rounded corners at lateral edges of said major and minor surfaces, thus defining a container of a designated, chosen shape and size, and with a first and second end. The designated shape and size are deliberately chosen as generally smaller than dictated airline standards for carry-on luggage. The remaining two of said six surfaces include a top, removable panel element and a bottom panel element affixed respectively to said first and second ends.

At least one handle element may be provided and adapted as a towing handle positioned at or adjacent said top panel, and one or more wheels may be provided at said bottom panel. When in a reclined or resting position on one of said lateral surfaces, the wheeled suitcase lies in a generally horizontal mode. In its rolling or standing position the wheeled suitcase assumes a generally vertical position where the lateral surfaces are substantially vertical. The phrase "substantially vertical," as applied herein, will be understood to include a slightly tilted attitude of the wheeled suitcase when pulled by said at least one handle and rolled in transport.

Another objective is to provide a uniquely configured garment bag designed to complement said designated or chosen shape and size of said container, and adapted to wrap around said substantially vertical surfaces of the wheeled suitcase. A final shape and size of the resultant combination of suitcase and garment bag are pre-designed to approximate said dictated standard. When applied or mounted to the suitcase, the garment bag fully covers the major and minor generally vertical outside panel surfaces of said suitcase, yet remains spaced from said removable top panel;

Another objective is that the garment bag be constructed to turn gently at rounded suitcase corners when mounted thereon, and uniquely adapted to be firmly connected to said suitcase surfaces so as to prevent sliding or unintentional removal thereof. Still another objective is to eliminate the need to fold the clothing or the garment bag containing said clothing. Instead of folding, the garment bag is gently wrapped around the outside of the suitcase surfaces, avoiding unwelcome wrinkles and creases.

Accordingly, the several objects and advantages of the invention allow large articles of clothing to be carried on the outside of a suitcase, while still providing substantial protection expected from typical garment bags. Not only does this configuration or arrangement eliminate the need to fold said clothing articles, but it also reserves more space within the suitcase for other articles. Another object of the present apparatus is to enable one to travel with large garments without the hazardous stress and discomfort of having to lift or carry a heavy garment bag. Still another object is to create a two-part luggage apparatus that can be used together as described herein, or as a separate garment bag and suitcase.

Other objects, features, and characteristics of the present invention will become apparent upon consideration of the following full description and the appended claims, with reference to the accompanying drawings, wherein like reference numerals designate corresponding elements in the various figures.

BRIEF SUMMARY OF THE SEVERAL VIEWS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of the inventive apparatus are provided herein. It is to be understood, however, that the present invention may be embodied in various forms. Therefore, specific details disclosed herein are not to be interpreted as limiting, but rather as a basis for claims included herein and as a representative basis for teaching one skilled in the art to employ the present inventive method and apparatus in virtually any appropriately detailed system, structure or manner.

Figure 1:
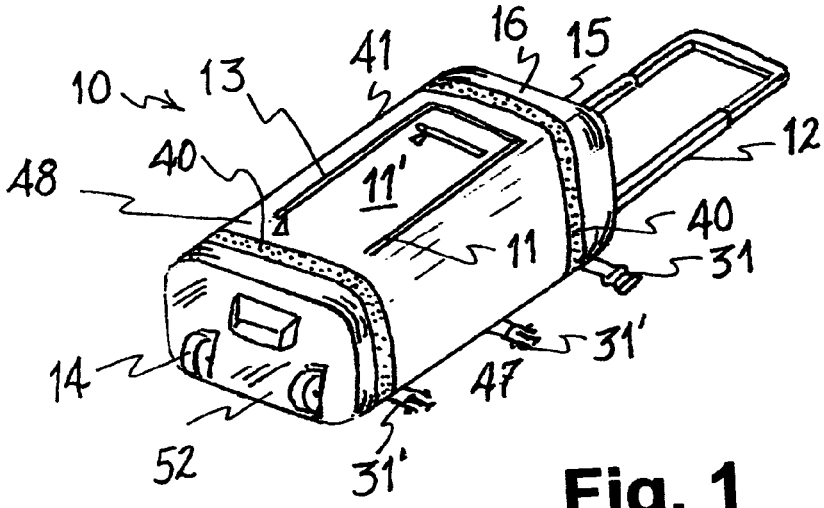
FIG. 1 is a front perspective view of the wheeled suitcase portion of the invention.
Figure 2:
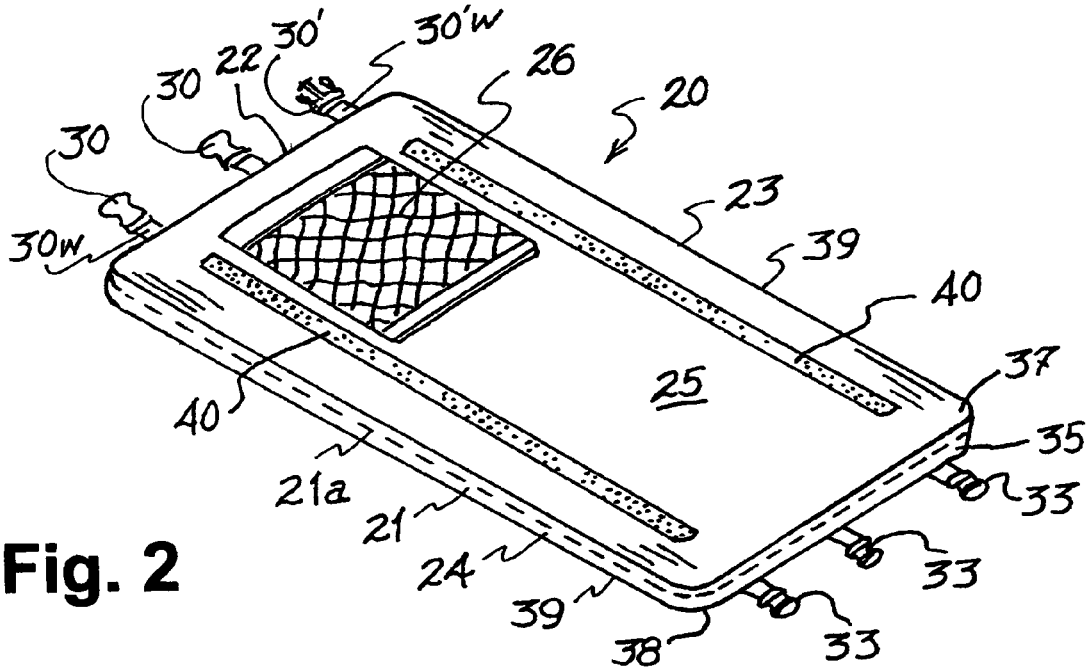
FIG. 2 is a perspective view of a dosed garment bag portion of the invention.

Referring to the drawings in detail, FIGS. 1 and 2 show the two main components of the invention, a wheeled suitcase 10 and a garment bag 20. At least one access opening 11 is defined on wheeled suitcase 10; said opening 11 is adapted to be closed by access panel 11'. Garment bag is shown (see FIG. 2) as having two generally elongated edges 39 bounded at their ends by two relatively shorter end edges, 22 and 35. At least one access opening 21 is defined on garment bag 20; said access opening is adapted to be closed by fastener 21*a* adapted to releasably interconnect at least three edges of the perimeter of the garment bag 20 so as to form a secure enclosure.

Garment bag fastener element 21 may be chosen from any of a variety of well known interconnecting elements. As examples, and without intent to limit the scope of the appended claims, fastener 21 may comprise one or more zippers, hook and loop fasteners, snaps, hook and eye fasteners, interlocking or connective clips of the male/female component interconnection type, and the like, or a combination of two or more of such fasteners. For purpose of illustration only, the drawings schematically depict fastener 21 as including zipper 21*a* (depicted in FIG. 2 as a broken line).

The wheeled suitcase 10 is presented herein as a generally rectangular container with six principal exterior surfaces (although other configurations such as square are within the scope of the present invention claims). In the example illustrated, two of said six exterior surfaces are constructed as major lateral surface panels 48, while two are minor lateral surface panels 47.

Figure 6:
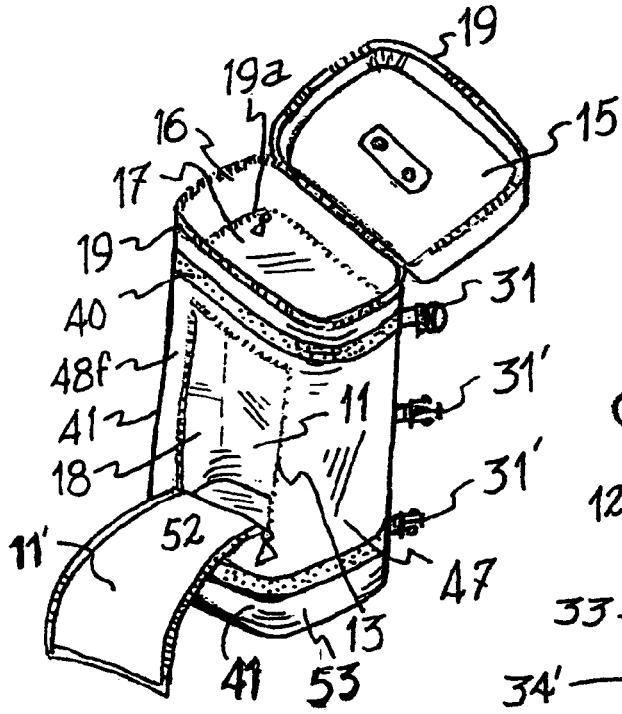
FIG. 6 is a front perspective view of a suitcase portion of the invention illustrated as including a top panel access and at least one major surface access opening ready for packing, but without the garment bag.

As viewed in FIG. 6, where said suitcase is in a generally vertical position, said major and minor lateral surface panels 47 and 48 are interconnected at their respective lateral edges to define said container having a first end 16 and second end 53, closed respectively by a top panel 15 and bottom panel 52. Said top panel 15 is adapted to be opened and fixedly closed.

Other openings may be provided on surface panels of suitcase 10 as deemed desirable or necessary for access and packing convenience. Lateral surface panels 47 and 48 have a relatively gentle, rounded interconnection at said lateral edges so as to present smoothly rounded corners 41, each (for example) with a radius of curvature. By itself, i.e., as shown in FIG. 6 without an attached garment bag 20, wheeled suitcase 10 has a resultant overall shape and dimensional size somewhat smaller than the commercial airline standard for carry-on luggage.

Figure 5:
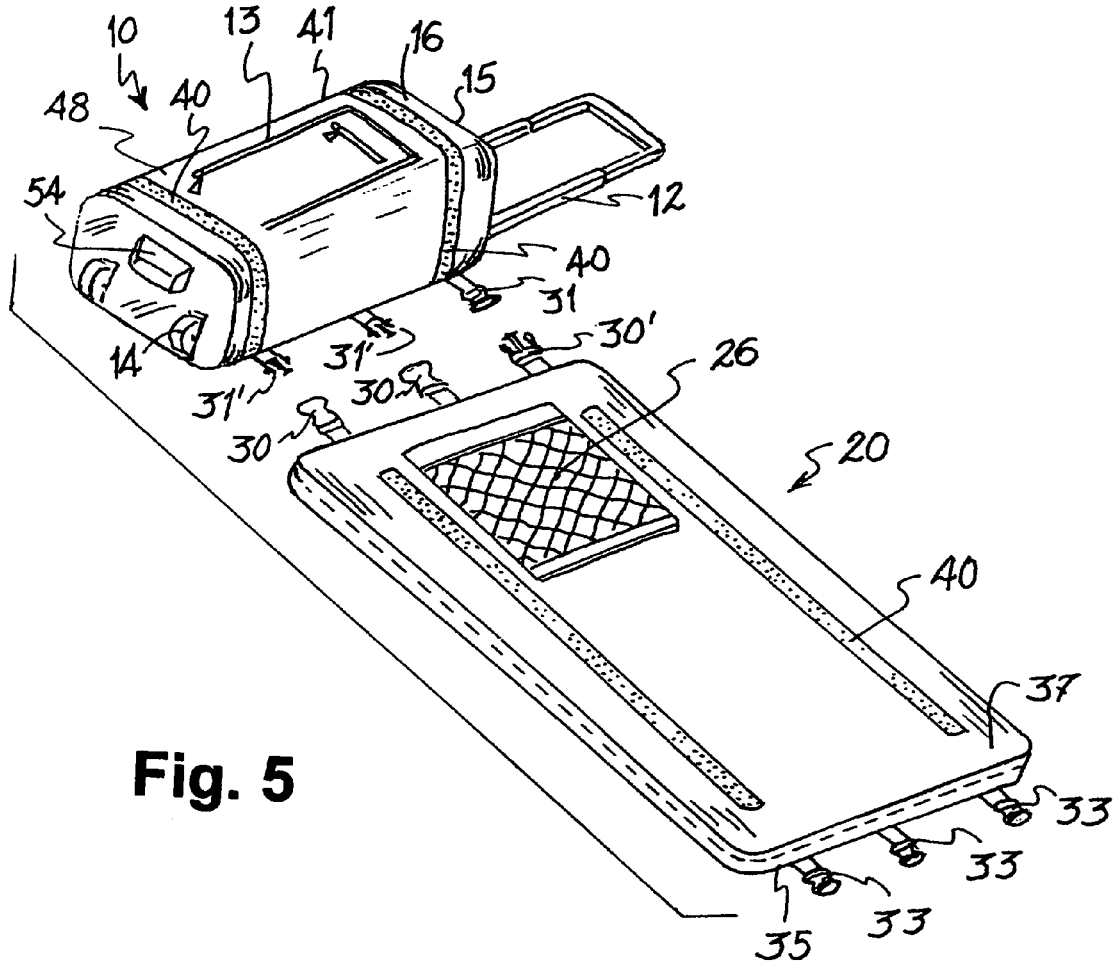
FIG. 5 is a perspective view of the invention with a garment bag aligned with a suitcase, ready for engagement.
Figure 7:
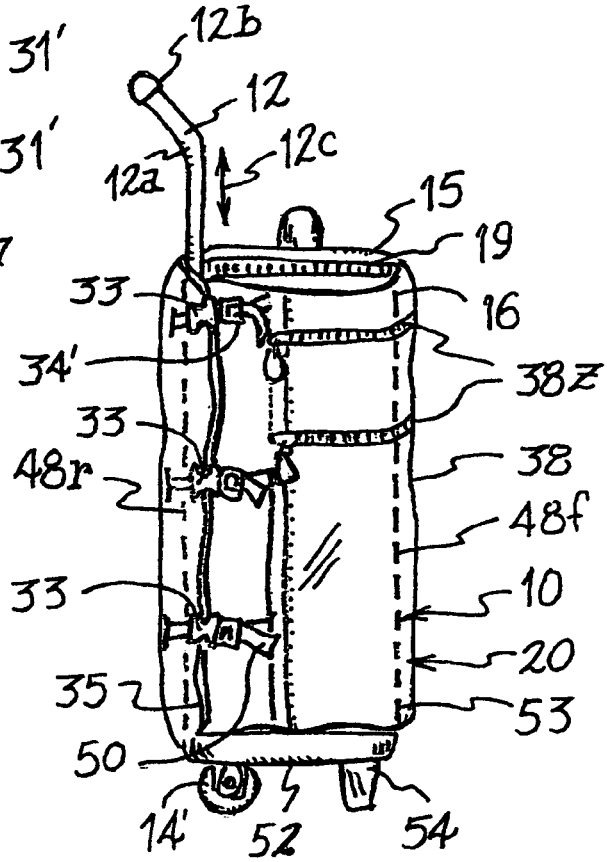
FIG. 7 is a side elevation of the invention illustrating details of the garment bag wrapped around a wheeled suitcase.

Said at least one towing handle may be provided in the form of retractable handle 12, and is illustrated in FIGS. 1, 5 and 7 as positioned along at least one major lateral panel surface 48 of said wheeled suitcase 10. Towing handle 12 is adapted to be slidably extended (as indicated by directional arrows 12*c* in FIG. 7) to a position well beyond said top panel 15. As illustrated, handle 12 is positioned along suitcase rear face panel 48*r* which may be termed the leading lateral surface when said suitcase is transported (or rolled) by being towed along a floor or other transit surface.

Towing handle 12 is further provided with a grip portion 12*b* configured to be grasped by at least one hand of a user. In its extended position, handle 12 may be straight relative to said at least one major lateral side or panel as indicated in FIG. 1. Alternatively, said handle 12 with grip portion 12*b* may have a slight bend or crook 12*a* (best viewed in FIG. 7) so as to require less tilt when tipping said wheeled suitcase for ease of movement.

A limited tilt of the suitcase 10 through the advantage of crook 12*a* results in a reduction in weight and force transferred to the user's wrist while pulling said wheeled suitcase. Another advantage of the limited tilt is that the user can avoid dragging a lower portion of said garment bag along the ground, walkway, roadway, tarmac, and so forth.

At least one wheel 14 is positioned along a bottom panel 52, normally adjacent said leading lateral surface or panel. Two wheels 14 are illustrated as an example. Said at least one wheel 14 may be recessed as illustrated in FIGS. 1 and 5, or fully exposed as shown in FIG. 7. A fully exposed wheel offers the advantage of further providing said wheel with a caster mechanism (not shown) to facilitate movement. Bottom panel 52 is provided with at least one lug or foot element 54. Said element 54 is adapted to extend from said bottom panel 52 to provide stable support for said wheeled suitcase when positioned in a generally upright or standing state as illustrated in FIG. 7. As wheeled suitcase 10 is tilted for rolled movement, the lug or foot element 54 is lifted from engagement with the floor or surface over which the wheeled suitcase 10 is moved.

Opened up as illustrated in FIG. 6, the wheeled suitcase 10 may be loaded with shoes, toiletries, and smaller articles of clothing through access opening 11 (or other openings provided therefor) on front surface 48*f*. The closure panel 11' for access opening 11 may be releasably secured with a zipper 13 or alternative fasteners of the type noted hereabove. For example, zipper 13 may extend substantially around at least three sides of the perimeter of access opening 11 and panel 11'. This is not, however, where larger articles of clothing such as dresses, shirts, suits or the like are to be loaded. Instead, larger articles are to be carried in the separate garment bag 20 uniquely adapted to be physically combined with suitcase 10.

Figure 4:
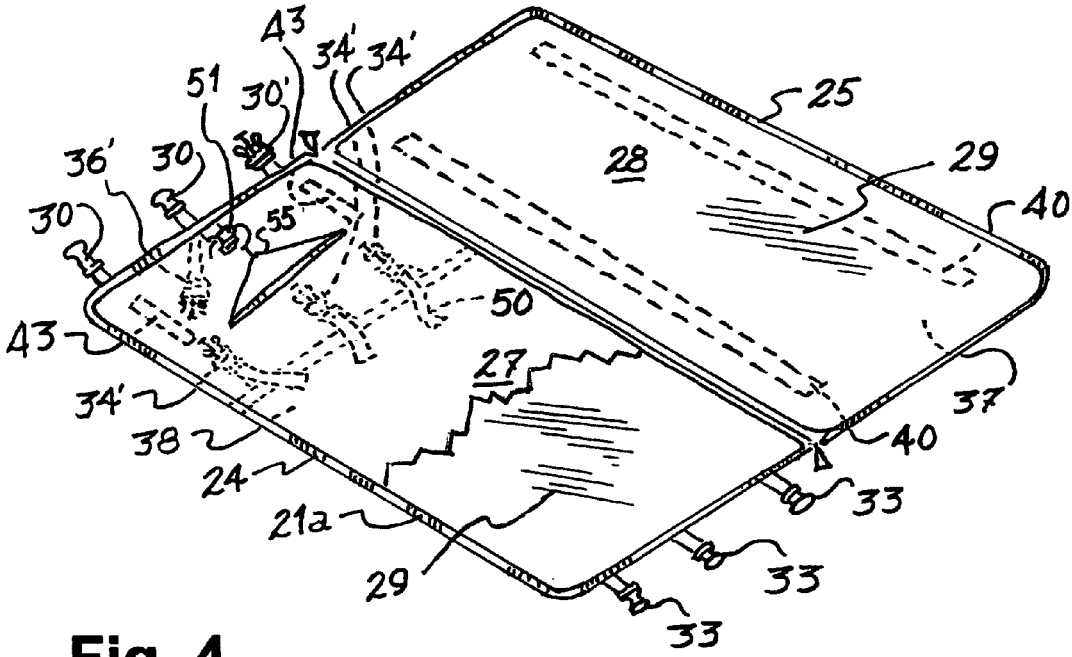
FIG. 4 is a perspective view of an opened garment bag.

Garment bag 20 is constructed as elongated in shape, including elongated side edges bounded at their ends by relatively shorter first and second garment bag end edges, 22 and 35 respectively. The first and second edges 22 and 35 are generally coextensive with said lateral edges of said four interconnected panels of said suitcase container. Garment bag 20 is provided with a zipper 21*a* (for example) which may extend substantially around three sides of a perimeter edge thereof. Thus, garment bag 20 is adapted to be opened to form two opposing or complementary halves, 24 and 25, so as to be closed and interconnected along a common edge 23 thereof as shown in FIGS. 2 and 4.

The opposing, complementary garment bag halves 24 and 25 are thus adapted to enclose therebetween large items of clothing of the type described hereabove. The novel structural design of garment bag 20 offers a useful accessory optionally connectable to a wheeled suitcase 10 for manual transport therewith. Of course, garment bag 20 and wheeled suitcase 10 are useful as stand-alone pieces of luggage.

Figure 3:
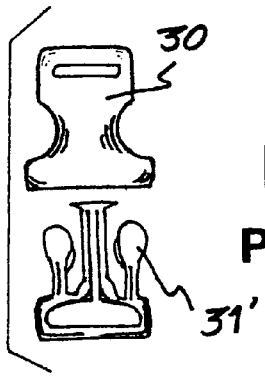
Fig. 3 PRIOR ART
FIG. 3 is a PRIOR ART illustration of well-known buckle connectors or male/female clips.

Garment bag 20 is to be attached to suitcase 10 by interconnection of fastener systems employing any of a variety of fastening elements (with options set forth hereabove with respect to fastener 21). As an illustration of the present inventive apparatus, and without intent to limit claim scope, these fastener systems are shown to comprise connectively interlocking clip elements. Such clip elements have cooperative or matching interconnection configurations (e.g., 30 and 31' shown in PRIOR ART FIG. 3). Fastener clip elements 30, 31 are typical of a variety of quick release buckles of the male/female type particularly suited for attachment to high strength nylon belts or webbing, and frequently employed in luggage, handbags, jackets, knapsacks and so forth. These interlocking clip elements are commercially available under the name UTX DURAFLEX® and WEINERLOCK®.

As illustrated, each set of clip elements of the present fastener systems is essentially the same construction (i.e., interconnecting male and female elements). However, clarity of explanation demands that a convention be assigned when referencing each clip element component. For example, a clip element component of the female type is designated 30; the male type, 30'. It will become evident that clip element components fixed at a common location on suitcase 10 or garment bag 20 carry common reference characters. For example all clip elements affixed at edge 22 of bag 20 are designated 30, 30, 30'; and associated webbing is designated 30*w* and 30'*w*. All such clips, by the way, are shown as associated with webbing strips.

It is important to note that precise placement of either a male or female fastener component element upon a luggage part to be interconnected is, in most cases, inconsequential so long as each said component element is matched with a clip element component of opposite gender. In other words, the male element component clip elements 31' and female components clip element 30 to be affixed to one or the other item or material surface to be interconnected may be positionally swapped as a matter of design or convenience. However, certain combinations of gender choice in clip element placement can have advantages as will be explained herebelow.

As shown in FIG. 1, a suitcase panel fastener system is illustrated along a panel 48 of suitcase 10, and includes one or more clip elements 31 or 31' (e.g. three clips) and associated webbing. Viewing FIGS. 2 and 4, it will be seen that a garment bag first end fastener system includes one or more clips, 30 or 30' affixed by fabric webbing (e.g., 30*w* or 30'*w*) to garment bag 20 at or near edge 22 of exterior bag half 24 as viewed in FIGS. 3 and 4. A garment bag second end fastener system including one or more clip elements (e.g. 33) is illustrated (also for example) as three juxtaposed clip elements affixed by fabric webbing strips (e.g., 31*w*) at edge 35 of exterior bag half 24.

Further, a garment bag external fastener system is indicated schematically (again for example) as three juxtaposed clip units (e.g., 34') with webbing strips (e.g., 34'*w*) at a location along exterior surface 38 of bag half 24 between said garment bag first and second end. For example, clip elements 34' are positioned on said exterior surface 38 between clips 30 and 31. The location significance and purpose of the aforementioned sets of clips located on exterior bag half 24 will become apparent when the assembly of the garment bag 20 and suitcase 10 is explained. It is important to note that clip units 34' are affixed to webbing strips 50 in such a way as to be adjustable, as will be explained.

Near said edge 22 of exterior half 24 is a single auxiliary clip element 36', shown for example as a male clip element in FIG. 4, with webbing adapted to releasably engage an adjacent female clip element 30 (selected for example as a center clip 30). Thus, when the garment bag 20 is detached from its wrapped position about suitcase 10, the auxiliary clip element 36' and center clip element 30 may be interlocked. When interconnected in this manner, the clip elements and their associated webbing join to form a loop from which said garment bag 20 may be hung on a hook or closet hanger bar (not shown). When not in use, clip element 36' and its associated webbing simply reside along the exterior half 24, concealed by an overlapping portion of said garment bag 20 in its wrapped position about the wheeled suitcase 10.

FIG. 4 illustrates garment bag 20 fully opened by separating bag halves 24 and 25 with internal surface panels 27 and 28, respectively, having smooth, waterproof inner faces or linings (see surface 29 partially illustrated in FIG. 4) for protectively enclosing larger clothing pieces. When garment bag 20 is closed and attached to suitcase 10, and subsequently wrapped therearound, (in such a way that bag 20 fully encompasses suitcase 10, yet remains spaced from the removable top panel 15), bag half 24 forms a relatively smooth continuous external surface 38 of the luggage combination. Thus, the outwardly facing surface 38 of half 24 may be fabricated of a ruggedly durable material such as that known as ballistic nylon.

Interior garment bag half 25 may be fabricated of a material which is less rugged and more flexible as compared to the external surface 38 just described, since bag half 25 will remain safely beneath the surface of the luggage combination. Surface 28 will be generally smooth so as not to frictionally engage, restrict or snag suits, dresses and such enclosed thereby.

The surface 37 (of panel half 25) adapted to directly engage the suitcase 20 may be fabricated of a light weight, generally smooth woven material, and may include at least one pocket 26 (see FIG. 2) for storing smaller items such as underwear, neckties, socks and the like. While pocket 26 may be structured or fabricated in a variety of ways and from a range of materials, the use of a mesh fabric provides the advantage of easily viewing pocket contents. In addition to the fastener systems just described, one or more auxiliary fastener elements are provided to aid in fixedly connecting garment bag 20 to suitcase 10, to be described as follows.

In order to accurately and firmly secure garment bag 20 to wheeled suitcase 10, auxiliary fastener elements are provided for interfacing portions of each. These auxiliary fasteners may be selected from a variety of connectors such as hook and loop fastener material, snaps, hook and eyelets, and the like. Illustrated in FIGS. 1, 2, 5, and 6 is the application of at least one strip of hook and loop fastener material 40 disposed on garment bag 20 (along surface 37) and aligned with at least one complementary strip of hook and loop fastener material 40 disposed on the suitcase 10 in a manner to be described. Hook and loop fastener material is generally available under the trade name VELCRO®.

While only a single unit of hook and loop fastener material 40 might be sufficient, FIG. 2 presents an example where a pair of such units is disposed on the suitcase-engaging surface 37 of interior half. Shown in FIGS. 1, 5 and 6 are corresponding or matching hook and loop fastener units 40, positioned on said wheeled suitcase 10 so as to be aligned with said hook and loop fastener units 40 on said interior half 25. While the hook and loop material 40 is shown in each instance as single elongated strips, it should be apparent that segmented strips will suffice, as well. With fastener systems and auxiliary fasteners appropriately prepared, packing and mounting of garment bag 20 may proceed as follows.

After opening the garment bag 20 (as for example unzipping said halves 24 and 25), articles of clothing such as suits, dress shirts, neckties, dresses, blouses and the like are placed onto the inside face 27 of the exterior half 24 of the garment bag 20. For example, suits may be placed on hangars (e.g., see 55) mounted in place on hangar loops 51. The bag 20 is generally rectangular in configuration, with a longer dimension and shorter dimension typical of rectangular shapes. Once said articles of clothing are in place on said exterior half 24, the opposing interior half 25 is folded over said clothing, and the two halves 24 and 25 are joined together, for example, by sliding zipper 21*a* along access opening 21. When closed, garment bag 20 is ready for attachment to the wheeled suitcase 10.

Suitcase 10 and garment bag 20, suitably packed with clothing and other articles are placed on a work surface such as a bed, table or floor. Said wheeled suitcase 10 is positioned adjacent to said garment bag 20 generally as shown in FIG. 5. The suitcase panel fastener system, including for example a first set of clip components 31 and 31' affixed to suitcase 10 are interconnected with a garment first end fastener system, e.g., a second set of clip components 30 and 30' affixed along a first edge 22 of garment bag 20.

Once the suitcase 10 and garment bag 20 are interconnected, the user then rolls or turns the suitcase 10 relative to the longer dimension of garment bag 20. The direction of wrapping will depend on the specific design or configuration of the garment bag, but the objective is to have the more rugged surface 38 on the outside of the luggage combination. With the relative motion of suitcase 10 and bag 20, the bag becomes wrapped around the lateral panels of suitcase 10.

In the FIG. 5 illustration, the garment bag 20 is designed so as to initially wrap across the front face or panel 48*f* of suitcase 10. In other words, if viewed in its generally upright position (i.e., on its wheels) the relative wrapping movement of garment bag 20 around suitcase 10 would be clockwise.

Alternatively, bag 20 could be configured to initially wrap across the rear face 48*r* suitcase panel (where the towing handle 12 is attached). This would result in a final wrapped condition as illustrated (merely as an example) in FIG. 7, where the garment bag 20 is shown as having been configured and wrapped counterclockwise relative to suitcase 10. This is a product design matter without consequence as long as rugged surface 38 will face outwardly of the combination suitcase and garment bag, When garment bag 20 is wrapped around suitcase 10, surface 37 is in direct contact with the exterior surfaces of suitcase 10. In their relative movement, these surfaces are aligned such that corresponding hook and loop fastener units 40 engage and mutually interlock, thus affixing garment bag 20 to suitcase 10. Rugged surface 38 of garment bag 20 then faces outwardly (with respect to the suitcase-garment bag combination) and provides a durable and protective surface for the clothes contained inside the garment bag 20. At least one additional hook and fastener unit 43 is positioned on a portion of said rugged surface 38 adjacent end 35 so as to engage at least one strip of hook and loop material 40 on inside surface 37.

As garment bag 20 continues to wrap around suitcase 10, second edge 35 of the garment bag 20 overlaps the first edge 22 thereof and the interconnected clip components 30, 30', 31, and 31'. Second edge 35 then continues around suitcase 10 to a point where said garment bag second end fastener system at edge 35, shown as clip components 33, engages with said garment bag external surface fastener system, e.g. clip components 34' positioned between said garment bag first and second end fastener systems.

Once connective clip components 33 and 34' are interconnected, webbing straps 50 associated with clip components 34' are tightened so as to pull bag 20 tightly against suitcase 10. Some positional readjustment of the engagement of hook and loop fasteners 40 may be necessary in order to ensure a smooth surface of bag 20 around the entire suitcase 10 and to minimize slipping and movement of clothing contained in bag 20.

A luggage combination of garment bag 20 and suitcase 10 (with panels 48*f* and 48*r* represented by phantom lines) is illustrated in FIG. 7, standing in a generally upright position. Web straps 50 are tightly adjusted in combination with clip elements 33 and 34'. Additional pockets on the exterior surface 38 of garment bag 20 are indicated by closures 38Z. As is apparent, surface 38 presents a relatively smooth continuous external surface including only optional, flat pocket zippers 38Z, Towing handle 12 with crook 12*a* is extended, and the luggage is ready to be tilted and advanced upon at least one wheel 14' shown here as exposed rather than recessed in bottom 52.

While traveling, the user may find it desirable or necessary to access the interior of suitcase 10 without having to remove garment bag 20 so as to reach main access door 11. With the current invention, this is easily accommodated. FIG. 6 illustrates the suitcase 10 structure with some elements removed (for simplicity of explanation). Top panel 15 of suitcase 10 is shown as opened up to expose interior space 18. Panel 15 is releasably securable with a zipper 19 extending around three sides of the panel 15 perimeter along top edge 16.

An interior panel 17 may be positioned so as to form a sub-container (or auxiliary container) within interior space 18. Panel 17 may be further opened by means of a fastener, e.g. zipper unit 19*a* along at least three sides thereof, thus providing further access to suitcase 10 contents without having to remove garment bag 20.

Because the garment bag 20 wraps around suitcase 10 without being folded as is necessary with conventional garment bags, it is advantageous to fabricate suitcase 10 with gently rounded corners as shown in FIGS. 1, 5 and 6. In other words, while lateral surfaces 47 and 48 of suitcase 10 extend at right angles to one another, they follow a radius of curvature 42 at their area of actual intersection. This rounded configuration avoids pressure points that would tend to crease or distress the clothing in the garment bag 20.

One possible method of manufacture to achieve these rounded edges is to use a curved piece of molded plastic (not shown) as a frame member of suitcase 10 either beneath or on the outside of the exterior fabric. Another method to achieve rounded edges is to use an internal frame utilizing vertical rods (not shown) of circular cross section placed within and along each corner edge 41 such that the exterior fabric of suitcase 10 wraps around and conforms to the shape of these frame members. These are merely examples of methods of manufacture and not intended in any way as limiting to appending claims.

In the earlier description concerning the manner by which the hanger bag 20 would be affixed to the wheeled suitcase 10, it was suggested that male and female clip components 30, 31' and the like may be positionally swapped (in terms of gender) as a matter of convenience. While this is the case, practically speaking, certain positional clip element placements can be advantageous. It has been found that selectively choosing gender placement (i.e., male and female) of clip components 30 relative to that of clip components 31' (as illustrated in FIGS. 2 and 5) will aid the user in quickly determining the correct "starting" orientation of the garment bag 20 where it first engages suitcase 10.

Returning to the description of the suitcase panel fastener system and said garment bag first end fastener system, it is pointed out that (in the example described) three fastener clips arranged along panel 48 of suitcase 10 include two end clips separated by a generally central clip. Note that one end clip component 31' is identical, in terms of gender, to the generally central clip component 31' (e.g. both male), while the remaining end clip component 31 is of a different gender (e.g., female).

Readied to fixedly receive clip components 31 and 31', the garment bag first end fastener system includes one male clip component 30' and two adjacent female clip components 30. Note also, that the garment bag second end fastener system, namely the set of clips affixed to the garment bag edge 35 all include female clip components 33. Thus, the garment bag 20 can be received and connected in only one orientation relative to said wheeled suitcase clips 31.

If the user, in confusion, attempts to attach clips 33 at edge 35 of garment bag 20 to suitcase 10, the clip array for 33 will find no matching clips (male-to female) in the clip array 31, 31'. Similarly, if the user attempts to place the external side 38 against the suitcase for attachment, clips elements 30, 30' will not find a match in the array of clips 31, 31'. Again, it is pointed out that the described fastener systems may comprise clips, as shown, or equivalent snaps, buttons, hook and eye connectors, zippers and the like, or a combination of such well known connectors.

Combining a garment bag and a wheeled suitcase into one apparatus, as described in this specification, has many advantages over existing luggage. All conventional luggage, from carry-on size up to the largest suitcase, requires large clothing to be folded to fit inside. Large luggage may require clothes be folded at least once (i.e., in half), and the smaller and more popular carry-on size luggage requires large clothing to be folded at least twice (i.e., in thirds). The result is that the folded clothing will develop at least one and typically two serious and unsightly creases due to having been folded.

The inventive apparatus described herein eliminates the need to fold large clothing. By wrapping the garment bag around the exterior of a suitcase with rounded edges, large clothing gently wraps around the perimeter of the suitcase, eliminating folding and creasing and reducing the chance for the clothes to become wrinkled. Wrapping large clothing around the outside of the suitcase also frees up space inside the suitcase. This allows the suitcase to be made smaller than a conventional suitcase. The result of reducing the size of the suitcase is that it weighs less and is easier to lift and easier to fit in confined spaces such as the overhead bins on an airplane.

Perhaps more importantly, interconnecting the garment bag and wheeled suitcase, provides the distinct advantage of avoiding having to carry the garment bag while wheeling the suitcase, thus incurring an added burden to the traveler and occupying both hands. Also eliminated is the clumsiness of draping a garment bag over the wheeled suitcase. Fastener systems for such combinations can easily be configured so as to direct the user in assembly of the combined luggage. Finally, an interconnected suitcase/garment bag unit of the type presented herein counts as only one carry-on bag, thus satisfying an increasingly imposed passenger carry-on limitation.

Upon careful reading of the foregoing specification and reviewing the accompanying drawings it will be evident that this invention is susceptible of modifications, combinations, and alterations in a number of ways which may differ from those set forth. Accordingly, the following claims are intended to cover all such alterations and modifications which do not depart from the spirit and scope of the invention.

What is claimed is:

1. Luggage apparatus comprising a combination wheeled suitcase and garment bag;

said suitcase including six panel surfaces wherein four of said six panel surfaces are adapted to interconnect at lateral edges thereof defining a container with an interior space of a designated shape and size, said container having a first end and second end;

two of said six panel surfaces include a top panel element and a bottom panel element, such top and bottom panel affixed respectively to said first and second container end so as to close said container;

a towing handle affixed adjacent said top panel and at least one wheel affixed at said bottom panel, said wheel adapted to support said suitcase in a generally vertical position;

a suitcase panel fastener system affixed to at least one of said four panel surfaces of said suitcase;

said garment bag defined as having first and second longitudinal ends to which are respectively secured a first end fastener system and a second end fastener system;

said garment bag further defined as having a relatively smooth continuous external surface and an internal surface configured to be wrapped fully around said four panel surfaces of said suitcase to a wrapped position wherein said garment bag internal surface fully covers said four panel surfaces;

said garment bag first end fastener system configured to connectively engage with said suitcase panel fastener system;

said garment bag second end fastener system configured to fixedly engage said garment bag external surface to hold said garment bag in position fully around said four panel surfaces of said suitcase;

whereby said garment bag is attached at its first end to said suitcase, wrapped fully around the four panel surfaces thereof, attached to its own external surface and thereby fixed in its wrapped position.

2. The luggage apparatus of claim 1 wherein said top panel is adapted to be opened and fixedly closed so as to provide access to said container interior space when said garment bag is in its wrapped position a suitcase interior panel is movably positioned so as to be spaced from said top panel to form an accessible sub-container within said interior space.

3. The luggage apparatus of claim 1 wherein said four panel surfaces interconnect at lateral edges thereof forming four rounded corners that extend substantially from said first end to said second end of said container;

whereby the garment bag wraps gently around said corners so as to avoid stress and wrinkling of clothing contained therein.

4. The luggage apparatus of claim 1 wherein said fastener systems include clip elements with interconnecting male and female elements.

5. The luggage apparatus set forth in claim 1, further including:

a garment bag external surface fastener system affixed to said garment bag external surface between said garment bag first and second end and configured to interconnect with said garment bag second end fastener system so as to hold said garment bag in position around said four panel surfaces of said suitcase as said suitcase is supported in said generally vertical position;

said fastener systems include clip elements each with connective male and female elements.

6. The luggage apparatus of claim 5, wherein said garment bag internal surface is configured to directly engage said suitcase, and said relatively smooth continuous external surface is configured to serve as an external surface of said combination suitcase and garment bag;

said internal surface of said garment bag including at least one auxiliary fastening element configured to engage surface panels of said suitcase;

at least one additional auxiliary fastening element affixed to said surface panels and positioned so as to fixedly engage said auxiliary fastening elements on said garment bag;

said external surface of said garment bag is fabricated of a substantially durable material with a smooth waterproof coating at an inner face thereof;

whereby said garment bag in its wrapped position about said suitcase provides an outwardly facing surface that is protective of clothing contained therein.

7. The luggage apparatus of claim 6, wherein said garment bag is elongated in shape, including elongated side edges bounded at their ends by relatively shorter first and second garment bag end edges;

said first and second end edges adapted to be generally coextensive with said lateral edges of said four interconnected panels of said suitcase;

whereby said garment bag in its wrapped position substantially covers said four suitcase panels.

8. The luggage apparatus of claim 5, further including an additional clip element and webbing affixed to said garment bag in a position near said garment bag second end fastener system, and directly adjacent to a center one of said clip elements of said garment bag second end fastener system;

said additional clip element having a gender complementary to said center one of said clip elements;

whereby said additional clip and webbing and said center one of said clip elements may be interconnected when said garment bag is unwrapped and disconnected from said suitcase, so as to form a hanging loop for said garment bag.

* * * * *